United States Patent [19]

Anselrode

[11] 4,107,003

[45] Aug. 15, 1978

[54] METHOD OF MANUFACTURING A SEAMLESS CYLINDRICAL STENCIL AND A SMALL-MESH STENCIL OBTAINED BY APPLYING THIS METHOD

[75] Inventor: Lodewijk Anselrode, St. Anthonis, Netherlands

[73] Assignee: Stork Brabant B.V., Boxmeer, Netherlands

[21] Appl. No.: 810,381

[22] Filed: Jun. 27, 1977

[30] Foreign Application Priority Data

Jun. 29, 1976 [NL] Netherlands ..... 7607139

[51] Int. Cl.[2] ..... C25D 1/08; C25D 7/04

[52] U.S. Cl. ..... 204/16; 204/11

[58] Field of Search ..... 204/11, 16, 24

[56] References Cited

U.S. PATENT DOCUMENTS

| | | | |
|---|---|---|---|
| 3,482,300 | 12/1969 | Reinke | 204/16 |
| 3,759,800 | 9/1973 | Reinke | 204/11 |
| 4,042,466 | 8/1977 | Anselrode | 204/11 |

*Primary Examiner*—T. M. Tufariello

*Attorney, Agent, or Firm*—Edmund M. Jaskiewicz

[57] ABSTRACT

A method of manufacturing a seamless cylindrical stencil comprising the steps of shrinking a small-mesh hose on a cylindrical support formed by a wire-netting, after which the threads of the hose and -if necessary- also of the support are made conductive, and finally a metal deposit by means of electro-plating is applied, the thicness of which is less than half the diameter of the hose threads.

5 Claims, 2 Drawing Figures

METHOD OF MANUFACTURING A SEAMLESS CYLINDRICAL STENCIL AND A SMALL-MESH STENCIL OBTAINED BY APPLYING THIS METHOD

BACKGROUND OF THE INVENTION

The present invention relates to a method of manufacturing a seamless cylindrical stencil, starting from a supporting sleeve upon which a non-metal hose is shrunk and secured by means of electro-plating. An embodiment of such a method is described in U.S. Pat. No. 3,759,800 in which a supporting sleeve is used upon which a nylon stocking is shrunk, and consequently completely embodied in a metal coating layer.

The invention is based upon the conception that a stencil, in particular for the rotational screen printing art, should satisfy to at least the following two conditions:

a. A considerable rigidity, especially for stencils with a great length, but also for stencils with a more reduced length which are subjected to a high squeegee load;

b. A high permeability for a fine detailed printing of the pattern.

SUMMARY OF THE INVENTION

The method according to this invention aims to meet these desiderata by the combination of the following features:

one starts from a non-deformable (forfmix) small-mesh wire netting;

the threads of the non-metal hose and eventually of the wire netting are provided with a conducting surface;

the hose is secured on the sleeve (wire netting) by an electro-deposited layer of a thickness smaller than half the diameter of the thread of the hose.

An important advantage of this method consists in that by making the threads of the hose conductive, in combination with the conducting surface (or the surface which is made conductive) of the threads of the wire netting, a relatively small thickness of metal deposit suffices, whilst yet a stencil is produced which has a great strength against deformation, thereby maintaining a considerable permeability.

It is observed that applying a conducting surface on the hose threads, when using a netting of non-metal threads may be realized in a separate treatment, but may also be combined with the treatment of the netting after shrinking the hose upon the non-metal netting.

A simplified embodiment of the present method consists in that one starts from a netting which is woven or knitted from metal wire. Under these circumstances only the hose need by provided with a conducting surface, after which the mutual anchoring can be executed by means of electro-plating.

The invention relates in particular to a method in which one starts from a netting with a wire thickness which exceeds the wire thickness of the hose. Under specific circumstances, the wire thickness of the netting may be at least five times greater than the wire thickness of the hose.

The invention also relates to a small-mesh stencil obtained while applying the method as indicated above, said stencil having an internal sleeve of a non-deformable netting, with which a non-metal hose is connected by electro-plating.

SURVEY OF THE DRAWING

In the drawings, FIG. 1 shows the cylindrical stencil and FIG. 2 shows a section on a considerably enlarged scale of the final product of the method.

DESCRIPTION OF THE PREFERRED EMBODIMENT

Figure 1:
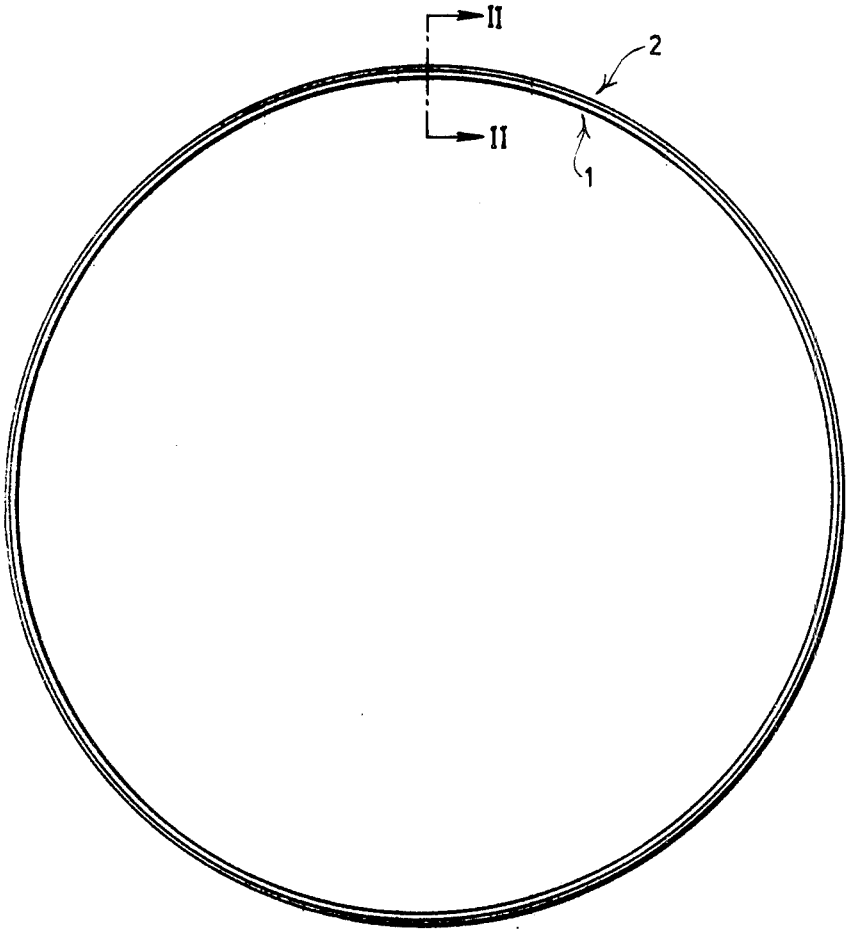
Figure 2:
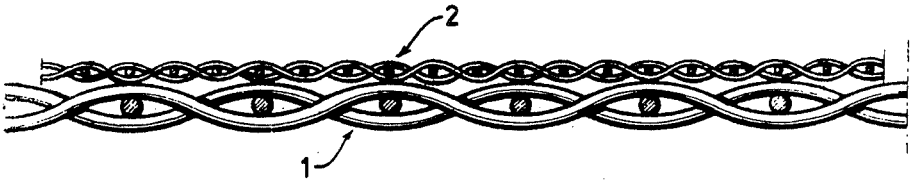

During the manufacture of the aimed seamless cylindrical stencil, one may start from a knitted or woven supporting netting 1 having a mesh-value of 5–30 holes per running inch. The hose 2 of non-metal threads to be mounted on the netting may have a mesh-value of 100–300. The permeability of both the netting mentioned above by way of example and the hose each amounts to at least 50%. The hose 2 is shrunk upon the netting 1, f.i. through a simple thermal treatment.

The surface of the threads of the netting 1 as well as of the hose 2 should be (made) conductive in view of the subsequently aimed electro-plating treatment. In case of the netting being also manufactured from threads of a non-conducting material, it is possible to perform said pre-treatment separately or combined. This pre-treatment for rendering the surface of the threads conductive, consists of the following cycle:

chemical degreasing;
flushing;
sensitising in a solution of stannochloride-hydrochloric acid;
flushing;
activating in a solution of diluted palladiumchloride-hydrochloric acid;
flushing;
currentless coppering;
flushing;

The composed product consisting of the hose 2 shrunk upon the netting 1 all the threads of which have a conducting surface, is dipped into an electroplating bath, f.i. consisting of a nickel solution of the following composition:

$NiSo_4 . 7\ H_2O$ 1,5 n $NiCl_2 . 6\ H_2O$ 0,5 n $H_3BO_3$ 0,5 n

In a usual manner, the anode is connected with the positive pole, and the stencil with the negative pole of a rectifier. Subsequently a tension of 7 volt is applied, during which a current occurs of 450 amp. After 15 minutes a deposit has been generated thusly that all the wires are covered whilst simultaneously a strong connection is obtained between the netting 1 and the hose 2. The thickness of the metal layer need not be much greater than 0,01 mm (= 10 micron).

What is claimed is:

1. A method of manufacturing a seamless cylindrical stencil comprising the steps of shrinking, a non-metal hose upon a formfix netting defining a supporting sleeve;

providing the threads of the non-metal hose and eventually of the netting with a conducting surface, and securing the hose upon the netting by means of an electro-plating deposit with a thickness which is smaller than half the diameter of the threads of the hose.

2. The method as defined in claim 1, wherein one starts from a netting which is woven or knitted from metal wire.

3. A method as defined in claim 1, wherein one starts from a netting having a wire thickness which is greater than the wire thickness of the hose.

4. The method as defined in claim 3, wherein one chooses a netting having a wire thickness of at least five times the wire thickness of the hose.

5. A small-mesh stencil obtained by applying the method as defined in claim 1, comprising an inner sleeve of a formfix netting, with which a non-metal hose is connected by means of electro-plating.

* * * * *